US005184453A

United States Patent [19]

Mima et al.

[11] Patent Number: 5,184,453

[45] Date of Patent: Feb. 9, 1993

[54] ROBOT FOR A DOUBLE TWISTER

[75] Inventors: Hiroshi Mima, Joyo; Tadashi Suzuki, Uji, both of Japan

[73] Assignee: Murata Kikai Kabushiki Kaisha, Kyoto, Japan

[21] Appl. No.: 860,243

[22] Filed: Mar. 27, 1992

Related U.S. Application Data

[63] Continuation of Ser. No. 588,082, Sep. 25, 1990, abandoned.

[30] Foreign Application Priority Data

Oct. 28, 1989 [JP] Japan ..... 1-257593
Nov. 29, 1989 [JP] Japan ..... 1-307761
Feb. 28, 1990 [JP] Japan ..... 2-45904

[51] Int. Cl.[5] ..... D01H 9/10; D01H 7/86

[52] U.S. Cl. ..... 57/270; 57/58.52; 57/261; 57/264; 57/268; 57/281

[58] Field of Search ..... 57/58.49, 58.52, 58.83, 57/58.7, 58.86, 261, 262, 264, 268, 269, 271, 278, 279, 281

[56] References Cited

U.S. PATENT DOCUMENTS 4,127,983 12/1978 Monker ..... 57/58.7 X
4,232,509 11/1980 Ronner et al. ..... 57/261
4,236,374 12/1980 Marbacher ..... 57/279
4,559,773 12/1985 Stahlecker ..... 57/261
4,671,054 6/1987 Grundmann et al. ..... 57/58.49 X
4,848,076 7/1989 Ueda et al. ..... 57/58.49 X
4,848,077 7/1989 Kawarabasni et al. ..... 57/278 X
4,928,475 5/1990 Matsui et al. ..... 57/58.49 X
4,928,476 5/1990 Otoshima et al. ..... 57/268

FOREIGN PATENT DOCUMENTS 3347318 7/1984 Fed. Rep. of Germany ..... 57/279

*Primary Examiner*—Katherine Matecki
*Assistant Examiner*—William Stryjewski
*Attorney, Agent, or Firm*—Spensley Horn Jubas & Lubitz

[57] ABSTRACT

An automatic doffing method for a double twister and a double twister movable along each unit of the double twister which is provided with a yarn supply package changing mechanism for replacing an empty feed package supported on a spindle of each unit with a feed package. A pick finding mechanism for drawing a yarn end from the feed package, a threading mechanism for inserting a yarn end into an axial hole of the feed package by way of an air flow, a doffing mechanism for removing a full winding package supported on the cradle arm of each unit and supplying a take-up tube to the cradle arm, and a yarn hanging mechanism for hanging a yarn end of the feed package on an empty take-up tube when the cradle arm supports the take-up tube.

9 Claims, 12 Drawing Sheets

ROBOT FOR A DOUBLE TWISTER

This is a continuation of application Ser. No. 07/588,082 filed on Sep. 25, 1990 now abandoned.

FIELD OF THE INVENTION

The present invention relates to a robot for a double twister which automatically carries out processing operations of changing of a package, yarn end finding, threading, doffing, yarn hanging and the like required to be done by the double twister, and also relates to a doffing method in the double twister.

RELATED ART STATEMENT

A double twister is designed so that a yarn drawn out of a feed package supported on a spindle is threaded through an axial hole thereof to wind on a take-up tube supported on a cradle arm while applying a double twist thereto to form a winding package. When the take-up tube winds all the yarns on the feed package to form a full winding package, an empty feed package is replaced by the full feed package (replacement of yarn), a yarn end is drawn (yarn end finding) out of the feed package, the full winding package is removed from the cradle to support a new take-up tube on the cradle (doffing), and a yarn end drawn out of the feed package is secured (yarn engagement) to the take-up tube.

In the past, these works have been exclusively manually carried out, taking much time.

However, in these days on which frequency of works such as doffing, replacement of yarn, etc. increases with trend of production of a small amount of a variety of products, it has been desired to employ automation of the aforementioned works in terms of reduction in labor and improvement in productivity.

OBJECT AND SUMMARY OF THE INVENTION

It is therefore an object of the present invention to provide a method capable of automatically carrying out replacement of feed packages, doffing, yarn hanging and the like while solving the aforesaid task.

Another object of the invention is to provide a processing method, where a double twister has a standard length device, doffing can be made a number of times from a single feed, and where doffing is carried out twice from a single feed, for example, the method is suited for both the first doffing and the second doffing.

The present invention provides an automatic doffing method for a double twister for dividedly winding yarns of feed packages several times on winding packages, wherein a work carrier movable along each unit of said double twister selectively carries out yarn changing or doffing operation, at a unit position issuing a full package signal, in accordance with said full package signal and a state of residual yarn on the feed side.

For example, in the case where doffing is carried out twice from a single feed package, the work carrier judges the first doffing and the second doffing, and at the full package for the first time, only the doffing operation and the yarn hanging operation are carried out in accordance with a full package signal and a signal in which a residual yarn on the feed side is present but the yarn changing is not carried out, whereas at the full package for the second time, doffing and yarn changing operations are carried out in accordance with a full signal and a signal in which a residual yarn on the feed side is not present.

The present invention further provides a robot for a double twister which can automatically carry out yarn piecing with respect to a unit which involves a yarn breakage.

The present invention still further provides a feed package carrying system in a double twister in which a mis-yarn-end finding package is not supplied to the spindle of the unit and the construction of the robot is simplified and the processing efficiency is enhanced.

DETAILED DESCRIPTION OF PREFERRED EMBODIMENT

One embodiment of the present invention will be described in detail with reference to the accompanying drawings.

Figure 1:
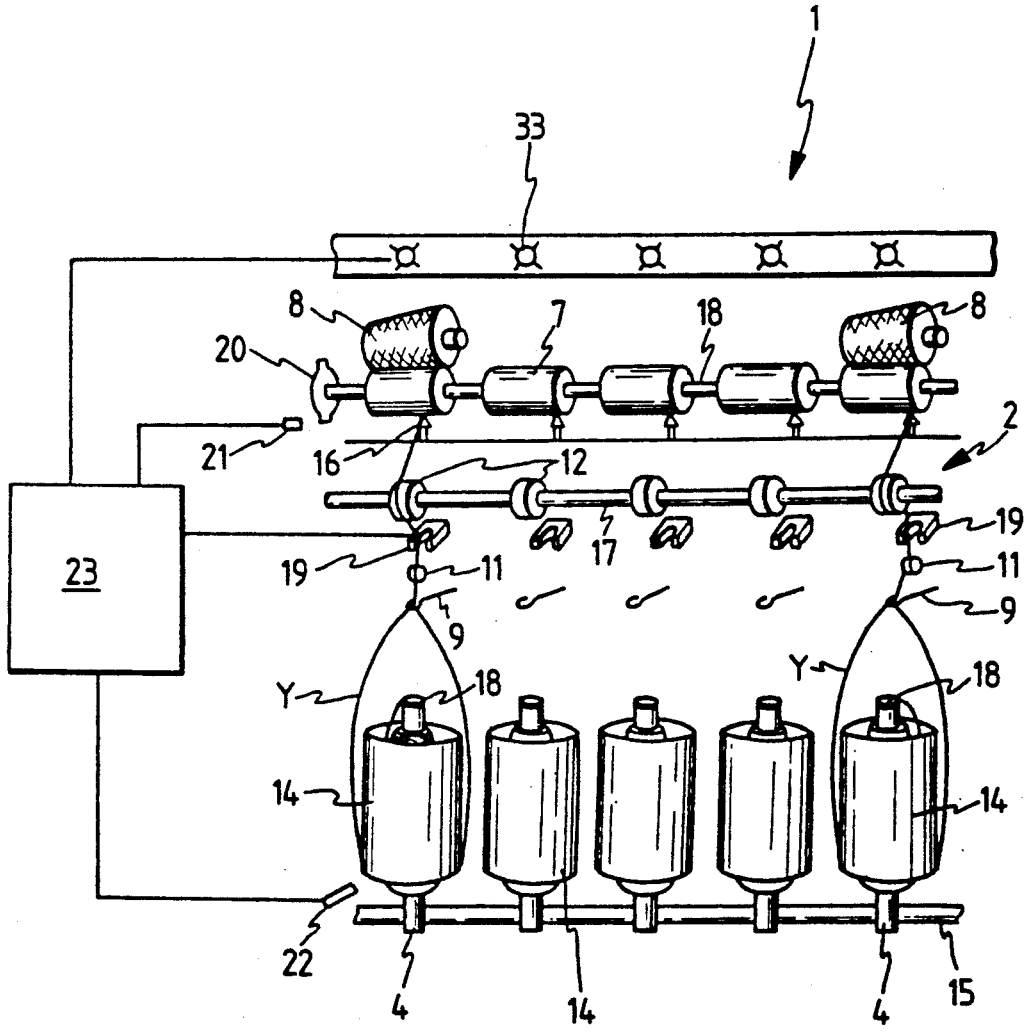
FIG. 1 is a perspective view of a schematic configuration showing one example of a double twister for embodying the present invention.
Figure 2:
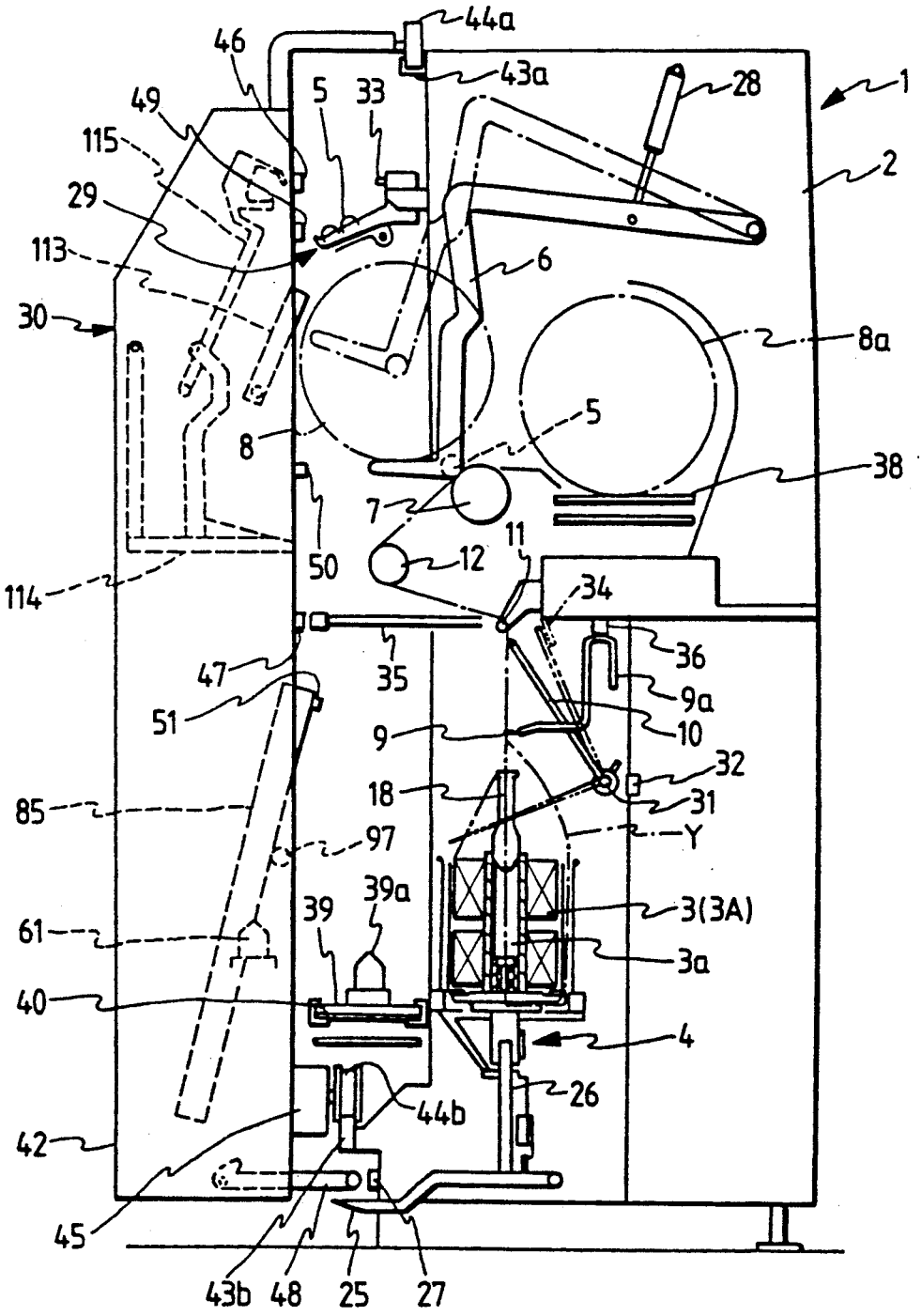
FIG. 2 is a side view of a schematic configuration showing the relationship between a work carrier and a double twister.

As shown in FIGS. 1 and 2, a double twister 1 has a number of units 2 juxtaposed. Each unit 2 is provided in its lower portion with a spindle 4 for vertically supporting a feed package 3 and in its upper portion with a cradle arm 6 for horizontally supporting a take-up tube 5 so that a yarn Y drawn out of the feed package 3 is threaded through an axial hole 3*a* and guided upwardly while applying a double twist thereto, and the yarn is wound on the take-up tube 5 rotated and driven by a rotary drum 7 to form a winding package 8. Above the feed package 3 are arranged in order a snail wire 9 for guiding a yarn, a drop wire 10 for detecting presence or absence of the yarn Y, a yarn guide roller 11 and a feed roller 12 for winding the yarn Y to supply it to the winding package 8.

A traverse guide 16 for traversing a yarn is provided frontwardly of the drum 7.

The spindle 4 for rotating a rotary disk of each unit 2 is rotated and driven by a single drive belt 15. The feed roller 12 and the drum 7 of each winding unit 2 are connected by shafts 17 and 18, respectively, for rotation.

A yarn-cut sensor 19 for detecting presence or absence of a travelling yarn is provided between the roller 11 and the feed roller 12 of each unit. The yarn-cut sensor 19 is of a photoelectric type, an electrostatic capacity type, a mechanical type and the like to detect presence or absence of the travelling yarn. A rotary body 20 is mounted on the shaft 18 of the drum 7, and a rotation sensor 21 for detecting rotational frequency of the rotary body 20 is provided. A cutter 22 is provided at the lower portion in the outer periphery of a fixed cylinder 14 of each unit 2.

A detection value of the yarn-cut sensor 19 of each unit and a detection value of the rotational sensor 21 are inputted into a yarn length counter 23. The yarn length counter 23 judges presence or absence of a yarn from the detection value of the yarn-cut sensor 19 of each unit per unit time. For only the unit in which the yarn travels, a yarn length per unit time is obtained on the basis of the detection value of the rotary sensor 21, and these are accumulated successively. Judgement whether or not the winding package 8 of the corresponding unit is full is made by the accumulated yarn length. When the winding package 8 is full, a green lamp 33 provided above each winding unit 2 is turned on and the cutter 22 is actuated.

As shown in FIG. 2, a pedal 25 is mounted at the lower portion of the unit 2. When this pedal 25 is lightly stepped, the spindle 4 is braked and stopped, and when the pedal 25 is fully stepped, compression air is supplied to a pipe 26 having an air jet hole. Upwardly of the pedal 25 is disposed a compression air supply valve 27 for supplying compression air to a work carrier (robot) 30 described later.

The cradle arm 6 is supported to be raised and lowered so as to bring the winding package 8 into contact with the rotary drum 7 or move the package 8 away from the drum 7. A cylinder 28 for raising the cradle arm 6 to a doffing position is connected to the cradle arm 6.

Upwardly of the cradle arm 6 is mounted a stocker 29 for storing a plurality of take-up tubes 5. The stocker 29 is forwardly downwardly inclined and is provided with a closeable bottom plate for removing the take-up tube 5.

The drop wire 10 has its base end supported on a lateral shaft 31 arranged at the rear of the feed package 3 and its extreme end placed against the yarn Y between the snail wire 9 and the yarn guide roller 11. When the yarn Y of the feed package 3 is empty or when a yarn-cut occurs, the drop wire 10 drops on the feed package 3 by own weight thereof. A microswitch 32 for opening and closing an operating valve of a cylinder 28 for a cradle arm is mounted on the base end of the snail wire 9 so that when the drop wire 10 drops, the operating valve is opened and the cradle arm 6 is raised to a doffing position by the cylinder 28.

Upwardly of the stocker 29 is mounted a display lamp 33 which is turned on when the cradle arm 6 is raised.

A conveyor 38 for delivering the doffed winding package 8 is disposed at the rear of the rotary drum 7, and a conveyor 40 for carrying a full feed package 3A placed on a tray 39 is disposed frontwardly of the feed package 3 along the unit 2.

Upwardly of the tray 39 is projected a peg **39*a* for erecting and supporting the feed package 3A**.

Frontwardly of the thus structured unit 2 is provided the work carrier 30 for automatically carrying out feed-package changing, threading, doffing and hanging in each unit 2 so that the carrier 30 can be travelled along the unit.

Rails **43*a* and 43*b* are mounted above and below the front portion of the unit 2. A carrier 42 is supported so that it can travel on the rails 43*a* and 43*b* through wheels 44*a* and 44*b*. A travel drive device 45 is connected to the lower wheel 44*b***.

A first sensor 46 for detecting the display lamp 33 and a second sensor 47 for detecting the display lever 35 are mounted on the carrier 30 so that when the lighting state of the display lamp 33 and the horizontal state of the display lever 35 are detected by these sensors 46 and 47, the travel drive device 45 is decelerated and stopped and the carrier 30 is positioned and stopped (indexed) at the front portion of the unit 2.

As means for detecting the doffing conditions, a third sensor 49 for detecting presence or absence of the take-up tube 5 within the stocker 29 and a fourth sensor 50 for detecting presence or absence of a winding package **8*a* on a winding package delivery conveyor 38 are mounted on the carrier 30. When the take-up tube-present state and the winding package-absence on the conveyor 38 are detected by these sensors 49 and 50**, judgement is made to the effect that the doffing conditions are fulfilled, and processing such as yarn changing, doffing or the like starts.

The carrier 30 is provided with a yarn changing mechanism for replacing an empty feed package 3B supported on the spindle 4 of each unit 2 with a feed package 3A, a yarn end finding mechanism for drawing a yarn end from the feed package 3A, a threading mechanism (air threading) for inserting a yarn end into an axial hole **3*a* of the feed package 3A by means of an air flow, a doffing mechanism for removing a full winding package 8 supported on the cradle arm 6 of each unit 2 and supplying the take-up tube 5 to the cradle arm 6, and a yarn hanging mechanism for hanging a yarn end of the feed package 3A on an empty take-up tube 5 when the cradle arm 6 supports the take-up tube 5**.

Operations of the aforementioned yarn changing, yarn end finding, threading and the like are executed by various mechanisms provided on an operating arm 85 within the carrier. The doffing operation is executed by a doffing mechanism comprising a lever 113 for opening and closing the cradle arm, a movable tray 114, a take-up tube supply arm 115 and the like.

The operating arm 85 is vertically movable, turnable and slidable and is provided in its extreme end with a fifth sensor 51 for detecting presence or absence of a residual yarn on the feed side of the unit so that when a first full package signal is issued, judgement is made whether or not at least a yarn layer for a second full package portion is present on the feed side. This can be accomplished by providing a mounting position of the sensor 51 to the arm 85 at a set distance position from the center of the feed package.

The doffing processing function achieved by the work carrier will be described hereinafter.

Figure 3:
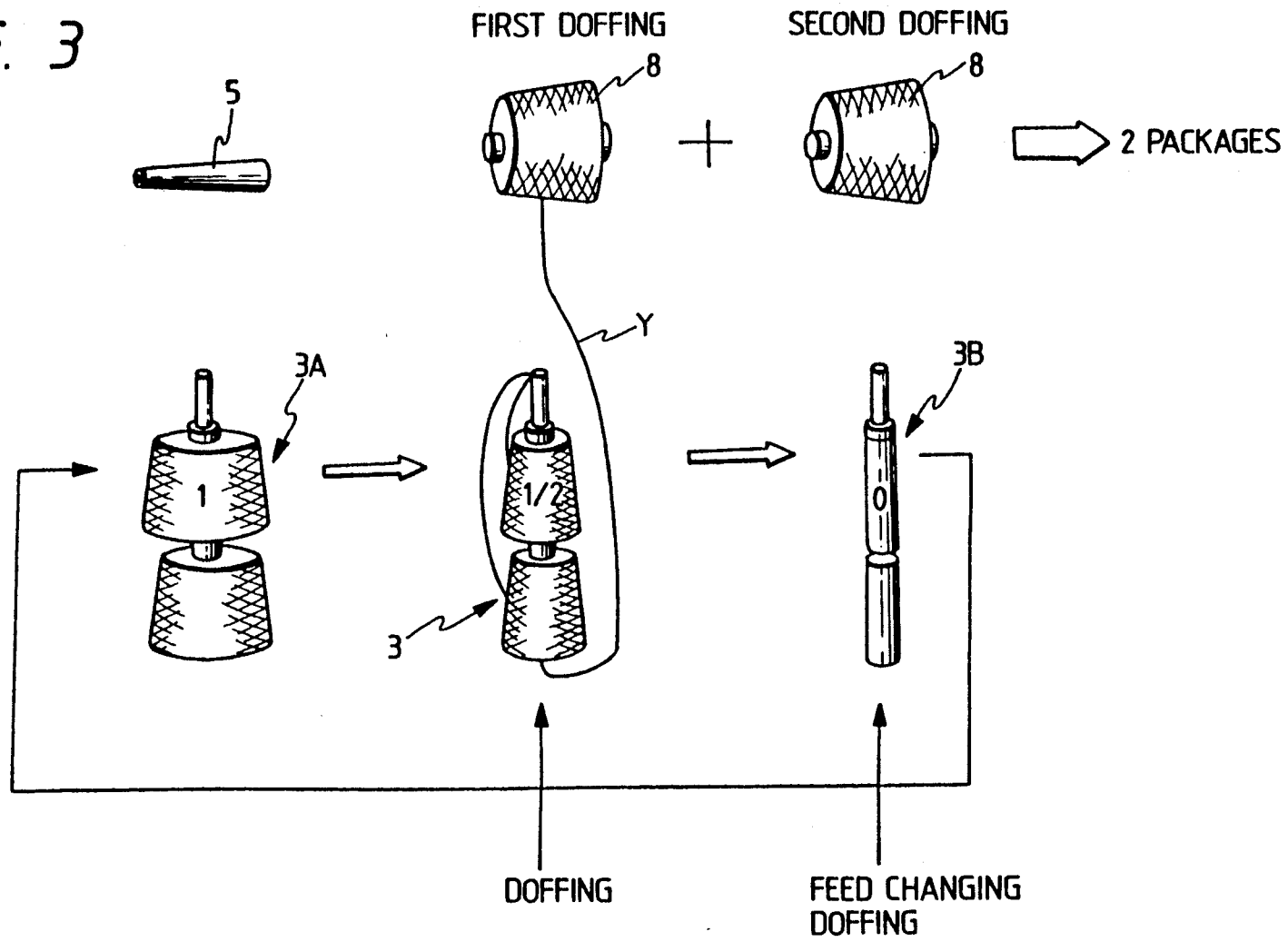
FIG. 3 is an explanatory view of the principle of a doffing method according to the present invention.

FIG. 3 schematically shows one example of the operation according to the present invention. That is, when the yarn Y folded on the empty take-up tube 5 is wound from the two-stage feed package 3A, during which an actually wound yarn amount is calculated by the yarn length counter 23 shown in FIG. 1 and reaches a set value, winding is stopped, and a yarn between the package 8 and the feed 3 is cut by the yarn cutting mechanism 22 to display a full package. The carrier 30 travelling along the unit detects said display 33 and stops at a position of the unit to carry out processing operation. At this time, in case of the first doffing, yarn changing is not carried out by a yarn-presence signal of the feed package 3, and changing of the full package 8 is carried out. When the second winding restarts, the carrier again starts to travel.

Next, when the unit again assumes a full package state and a full package signal 33 is issued, the work carrier again stops. Since this is the second doffing, no residual yarn is present on the feed side. Accordingly, the carrier carries out yarn changing and doffing operation.

In the present embodiment, of course, the feed package shown is a two-stage feed. However, the present invention can be applied even to the type in which two winding packages are obtained from a single feed package. Furthermore, while in the present invention, an example of a divisional winding in which two doffing operations are carried out from a single feed package has been shown, it is to be noted that the number of divisions is suitably determined, three times or more doffings may be employed. In this case, with respect to the mounting position of a residual yarn detection sensor on the feed side, that is, the detection position, it is necessary to provide the aforesaid sensor at a position capable of detecting a residual yarn position in which at least one full package can be wound.

Figure 4:
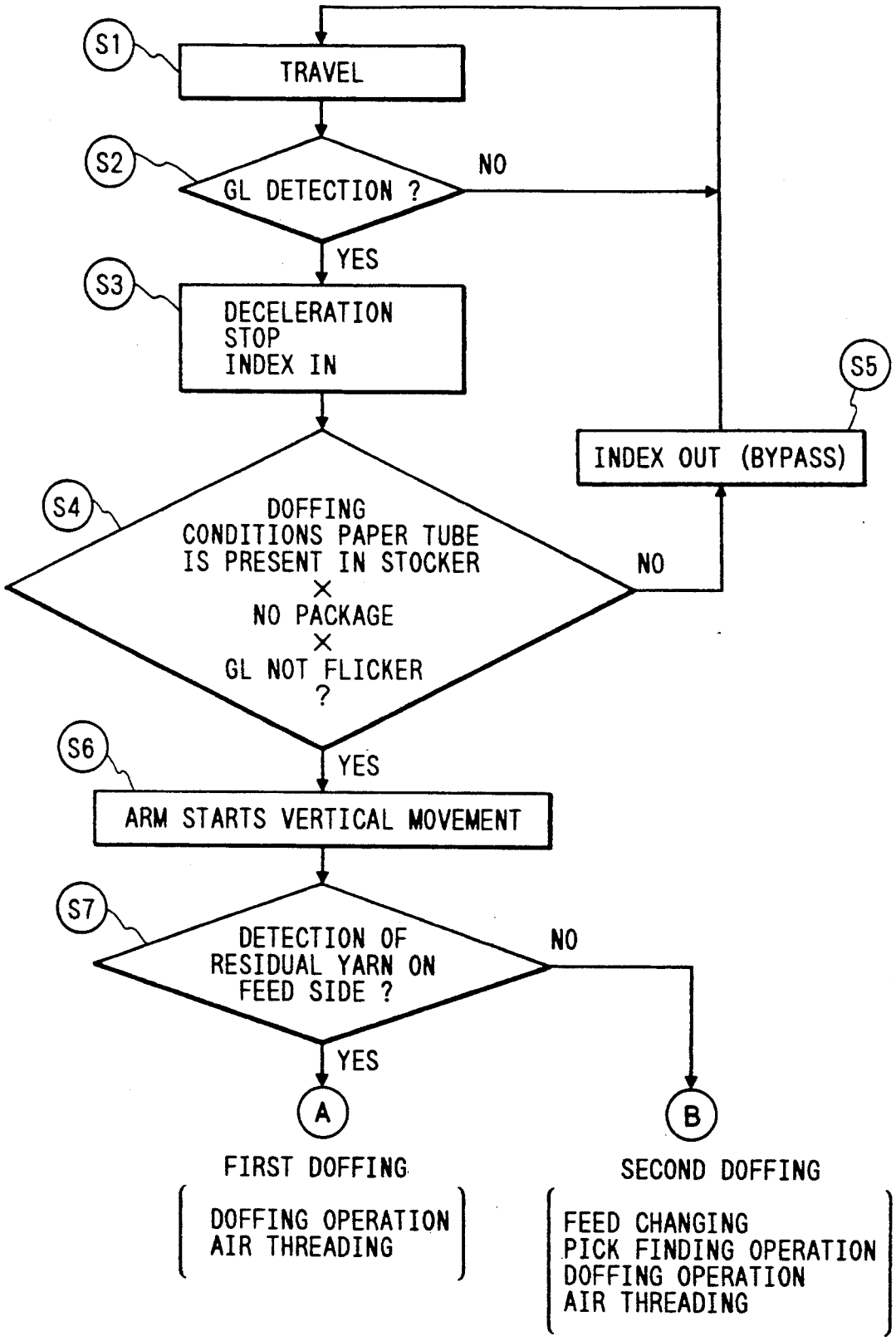
FIGS. 4 to 6 are flowcharts showing one embodiment of the method according to the present invention.
Figure 5:
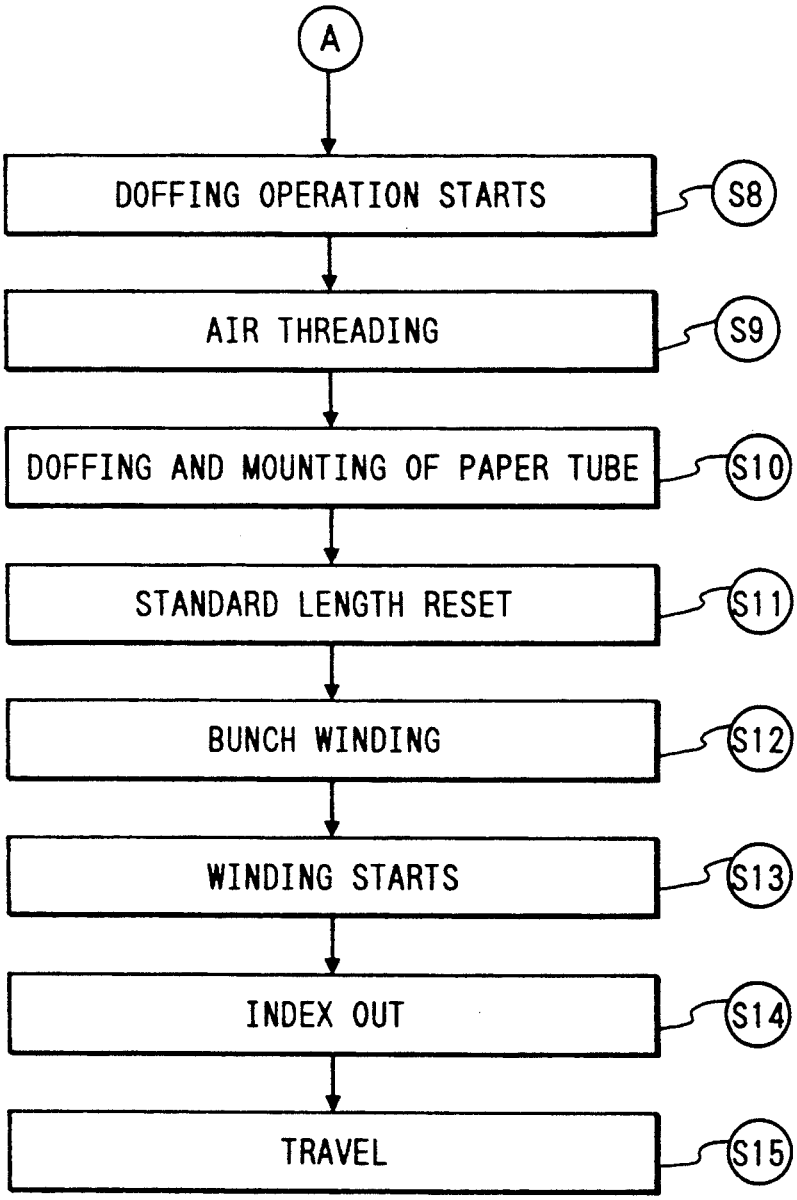
Figure 6:
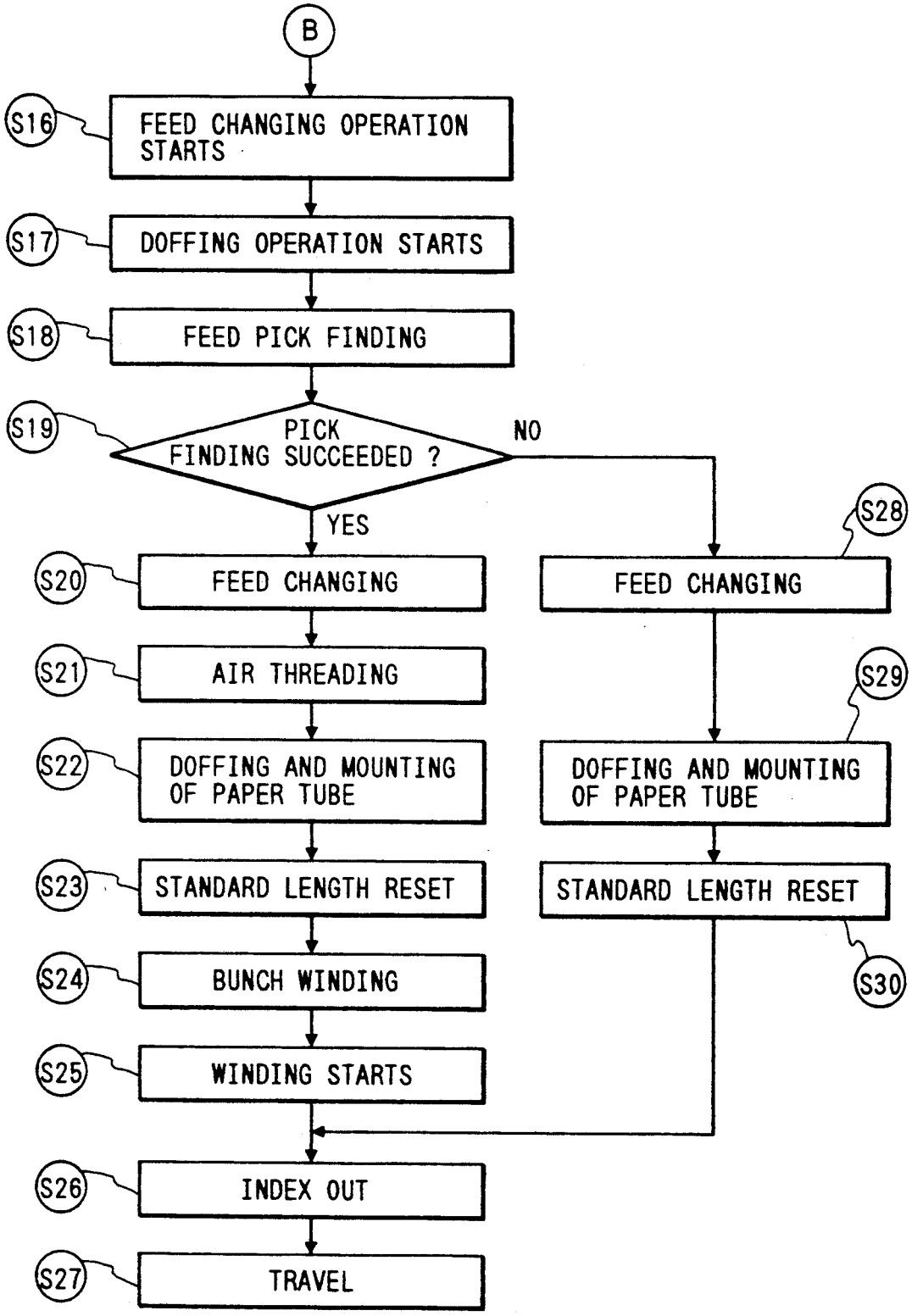

FIGS. 4 to 6 show operation flowcharts for explaining the function of the present embodiment.

The work carrier 30 travels S1 along the unit 2. When the lighted display lamp 32 and the horizontal-state display lever 35 are detected S2 by the sensors 46 and 47, the carrier 30 lowers its speed and stops in front of the unit 2 to assume index IN S3. In this state, whether or not the doffing conditions (a take-up tube is present on the stocker, and a winding package is not present on the delivery conveyor) are fulfilled is detected S4 by the sensors 49 and 50. In case of "NO", index OUT results S5, and travel of the carrier 30 restarts S1.

In the case where the doffing conditions are fulfilled, vertical operation of the operating arm 85 starts S6. The pedal 25 is lightly stepped by the pedal lever 48 to stop the rotation of the spindle 4, and a compression air introducing portion is connected to the compression air valve 27. An expansion arm (not shown) provided on the operating arm 85 presses a turning lever of the display lever 35 to depress the display lever 35, and presence or absence of a residual yarn detection sensor 51 S7. In case of residual yarn-presence, judgement is made to be the first doffing, and execution proceeds to step A. In this case, yarn changing is not carried out but only the doffing operation, air threading and yarn hanging operation are carried out. In FIG. 5, doffing operation starts S8. That is, a yarn is cut at the cutter 22 position in FIG. 2 according to a full package signal, and a yarn end running to the feed side is threaded by air threading S9. That is, the yarn is blown upwardly of the outer periphery of the cylinderical body 14 by air jetted from the air pipe 26 and sucked and held by a suction pipe for holding a yarn end (not shown) at a standby state. During that period, the full package 8 is disengaged from the cradle 6 and delivered onto the conveyor belt 38 by advance of the tray 114 or the like, and the empty take-up tube 5 within the stocker 29 is delivered to and mounted on the cradle 6 by the operation of the take-up tube mounting mechanism 115 S10. At this time, when the yarn end on the feed side held as described above is mounted to the cradle of the empty take-up tube, the yarn end is held between the end of the empty tube and the take-up tube tray of the cradle, whereby the yarn runs between the feed package and the empty take-up tube. Subsequently, the cradle 6 is moved down by the operating arm on the carrier 30 side, and an empty take-up tube is set onto the drum 7. At this time, the standard length device is reset by electric interlocking caused by downward movement of the cradle S11. Then, a bunch winding is executed S12. When winding starts S13, a stop positioning index of the carrier is OUT S14, and travel of the carrier 30 restarts S15.

Incidentally, when the yarn threading 59 is finished, the operating arm 85 acts to return the snail wire 9 to the general position and to insert the yarn end into the snail wire 9. Then, the pedal 25 is released from the deeply stepped condition to start the rotation of the spindle 4. The yarn is twisted and is guided to the yarn guide roller 11.

The end of the yarn is wound on the takeup tube to apply a bunch-winding by imparting twists to the yarn appropriately, so that inconvenience of bunch winding without twists can be prevented and the step for unwinding and removing the untwisted bunch winding portion can be omitted. So, working efficiency of the next step can be increased.

On the other hand, in step S7 shown in FIG. 4, in case where a residual yarn on the feed side is not present, judgement is made to be the second doffing, and execution proceeds to step B. In this case, yarn changing operation and doffing operation start (S16, S17 in FIG. 6).

That is, in the changing operation, the chucker on the carrier side pulls out a new feed package mounted on the tray 39 on the conveyor 40 and being carried, and the package is mounted on the peg 61 within the carrier. A given amount of the yarn end is drawn out of the package by the yarn end finding mechanism of the yarn end provided with the carrier 30 S18.

Whether or not the yarn end finding has succeeded is detected by the photoelectric sensor or the like in step S19. If YES, the changing operation is carried out S20. An empty feed package 3A on the unit side is transferred onto an empty tray 39*a*, and a new feed package on the peg 61 on the carrier side is set onto the spindle 4 of the unit. Subsequently, air threading is carried out in which a yarn end subjected to yarn end finding in advance is threaded into the spindle from the center hole S21. Subsequently, winding starts, and travel of the carrier starts in a procedure similar to that of step A above S22 to S27.

On the other hand, in step S19, in the case where the success of yarn end finding is NO, i.e., mis-yarn-end finding, the yarn changing is carried out S28 but air threading operation is not carried out. Doffing and mounting of a take-up tube are carried out S29. The cradle is somewhat lowered, and the standard length setting S30 is carried out without contacting into the drum 7. Winding is not restarted, and the lamp 33 is flickered. The carrier starts its travel.

By the above-described operation, doffing for two full packages can be made from one feed.

When a yarn-cut occurs before reaching a full package during winding, the drop wire 10 drops. The microswitch 31 is turned on similarly to cutting of a forced yarn at the time of full package as described above whereby the cradle 6 is moved upward, and the package is parted from the drum 7. However, since at this time, a package not full, the display lamp 33 is controlled so as to be flickered. Accordingly, the sensor 46 is once stopped by the lamp 33. However, the lamp flickers in a predetermined period unlike the case of the full package in which lighting continues. Therefore, flickering can be judged and bypassing is provided without yarn changing as well as doffing. When an operator finds that flicker signal, the operator carries out yarn-cut processing. Also, in step S4 shown in FIG. 4, when judgement is made to the effect that the doffing conditions are not ready, the carrier bypasses. At this time, the operator carries out supplying of a take-up tube to the stocker 29 and processing of the package 8*a* on the conveyor 38. While as the judging means for frequency of doffing, the case where detection of a residual yarn is carried out has been shown in the above-described embodiment, it is to be noted that the frequency of doffing in each unit is stored in a controller on the machine bed, and when the carrier stops at the unit of full package signal, operation of the carrier may be instructed from the controller. In this case, the residual yarn detecting step can be omitted.

As described above, according to this embodiment of the present invention, in a double twister for producing a plurality of winding packages from a feed package, processing on the feed side and processing on the full package side according to the frequency of doffing and the state of feed are carried out, and therefore, the work carrier may be operated without waste, and extremely effective yarn processing can be made.

Of course, the present invention may be applied to a doubler, and other winders in addition to a double twister.

Next, an embodiment in which the working carrier (robot) performs a yarn piecing operation for a spindle unit where a yarn breakage occurs will be illustrated.

In this embodiment of the present invention, a piecing mechanism for automatically piecing a yarn end of a winding package supported on a cradle and a yarn end of a feed package on a spindle is provided on a robot body provided travelably along a unit of double twister.

When the unit involves a yarn breakage, the piecing mechanism on the robot body automatically pieces a yarn end on the winding package side and a yarn end on the feed package side.

The embodiment will be described in detail with reference to the accompanying drawings.

Figure 7:
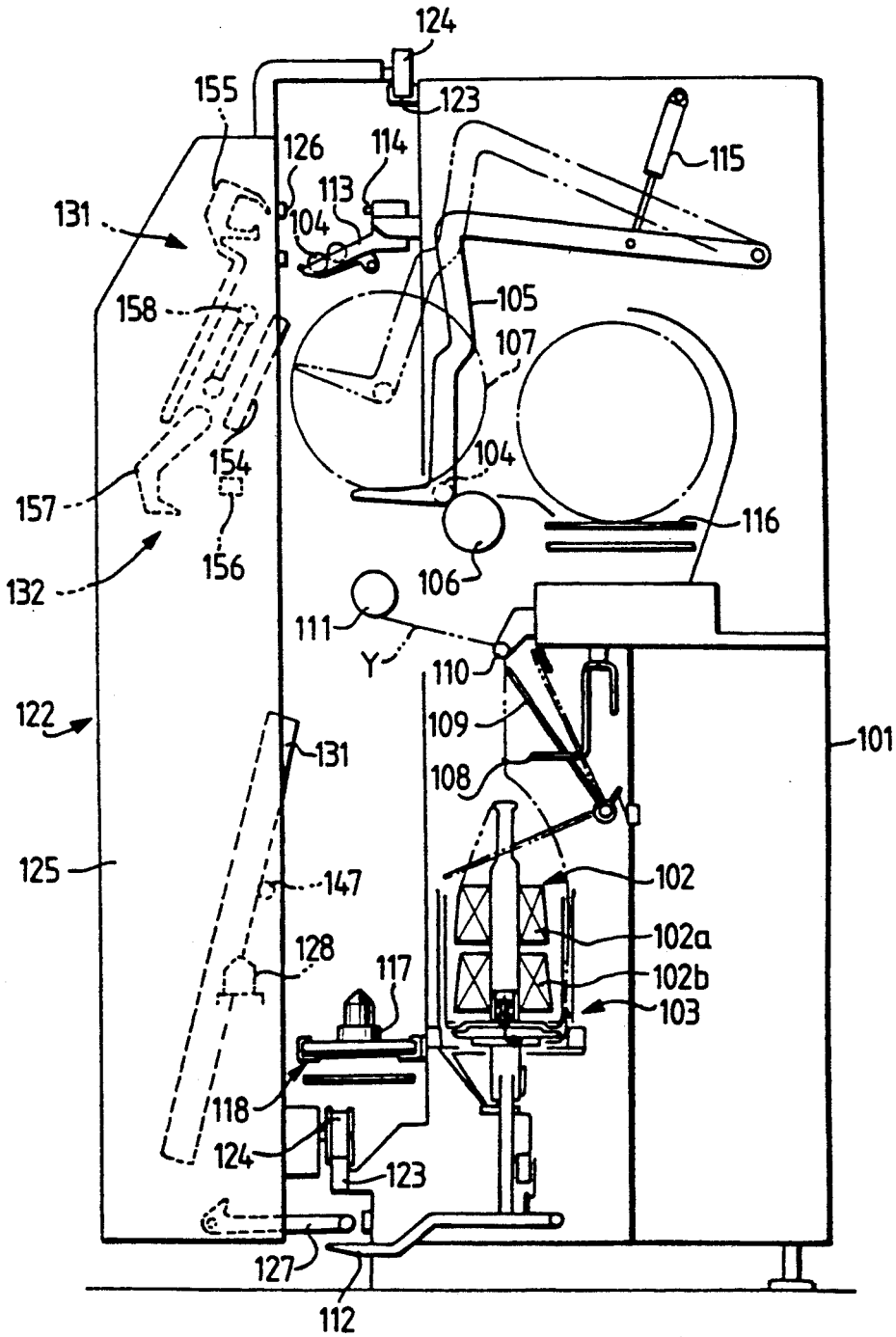
FIG. 7 is a side view showing one embodiment of a robot for a double twister according to the present invention.

As shown in FIG. 7, each unit of a double twister is provided in its lower portion with a spindle 103 for vertically supporting a feed package 102 and in its upper portion with a cradle 105 for horizontally supporting a take-up tube 104, so that a yarn Y drawn out of the feed package 102 is threaded into a center hole thereof and guided upwardly while applying a double twist thereto, and the yarn is wound on the paper tube 104 rotated and driven by a rotary drum 106 to form a winding package 107. Above the feed package 102 are arranged in order of a snail wire 108 for guiding the yarn Y, a drop wire 109 for detecting presence or absence of the yarn Y, a yarn guide roller 110 and a feed roller for supplying the yarn y to the winding package 107. At the lower portion frontwardly of the unit 101 is provided a pedal 112 for jetting compression air to brake and stop the spindle 103 at a shallow step and thread the yarn into the center hole at a deep step, and above the unit are provided a stocker 113 for storing the take-up tube 104, a display lamp 114 to be lighted when the drop wire 109 falls due to the yarn cut or the like, and a cylinder 115 for raising the cradle 105.

A conveyor 116 for delivering the doffed winding package 107 is provided at the rear of the rotary drum 106, and a conveyor 118 for carrying the feed package 102 stood upright on a tray 117 is provided along the unit 101 frontwardly of the spindle 103.

In the present embodiment, as the feed package 102, a two-stage type feed package is used in which packages 102*a* and 102*b* not doubled are superposed vertically so that in the unit 101, yarns Y1 and Y2 from the upper and lower packages are doubled and subjected to double twisting. The feed package 102 is mounted in the state where two packages 102*a* and 102*b* are superposed on a cylindrical adapter 119 from the upper end with a spacer 120 sandwiched therebetween. At the upper end of the spacer is integrally formed a top cap 121 for inserting and guiding the yarns Y1 and Y2 from both the packages 102*a* and 102*b* into the adapter 119. The feed package 102 is carried on the conveyor 118 in the state where the yarn ends of both the packages 102*a* and 102*b* are wound on the top cap 121.

Since the yarn ends of both of the upper and lower packages are wound together on the top cap, the processing robot may easily find out the both yarn ends at a time only by sucking the yarn ends by means of a suction mouth which may be put to cover the top cap so that the next yarn threading process can be easily performed.

Frontwardly of the unit 101 constructed as described above is provided a robot 122 so as to be moved round along the arranging direction thereof. This robot 122 comprises a robot body 125 in the U-shape in front provided with a wheel 124 which travels on rails 123 provided up and down of the unit 101 so that the lighted display lamp 114 is detected by a sensor 126, and the robot stops frontwardly of the unit 101. The pedal 112 is stepped by a lever 127 to stop the spindle 103 and a tray 117 on the conveyor 118 is stopped by a stopper not shown. On the robot body 125 are provided a peg 128 for temporarily placing the feed package 102 for the purpose of yarn end finding, a yarn end finding mechanism 129 for finding the yarn end of the feed package 102 on the peg 128, an operating arm 130 for moving the feed package 102 from the tray 117 on the conveyor 118 onto the peg 128 and moving the empty feed package 102 on the spindle 103 onto the tray 117, a doffing mechanism 131 for moving the full winding package 107 from the cradle 105 onto the conveyor 116 to supply the take-up tube 104 from the stocker 113 to the cradle 105, a piecing mechanism 132 for piecing (relay) and the like.

Figure 10:
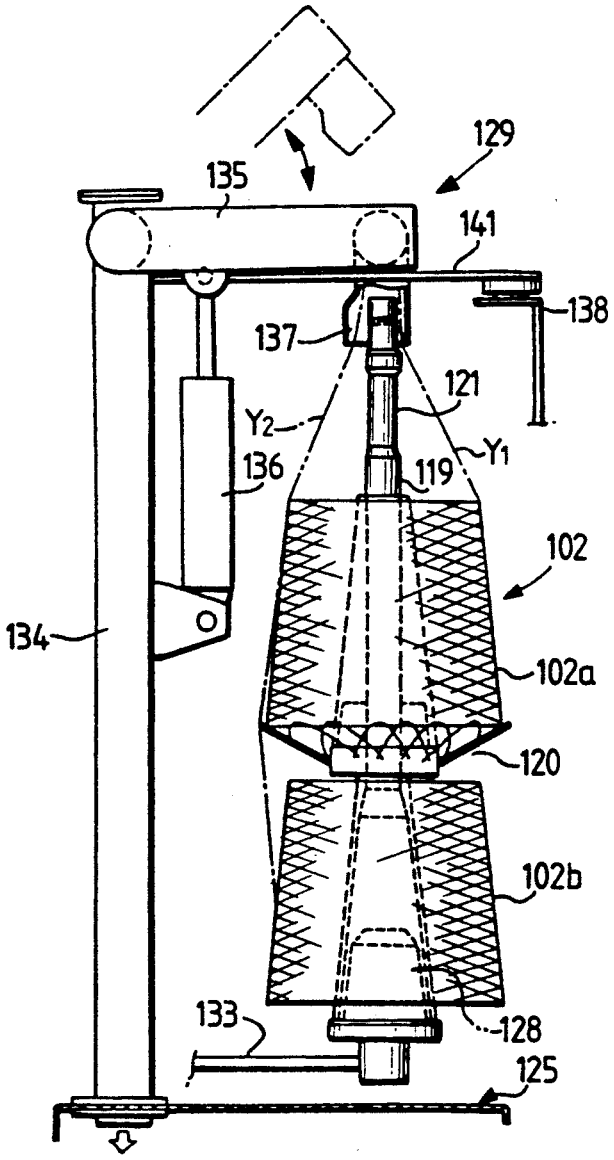
FIG. 10 is a side view showing a yarn end finding processing.
Figure 9:
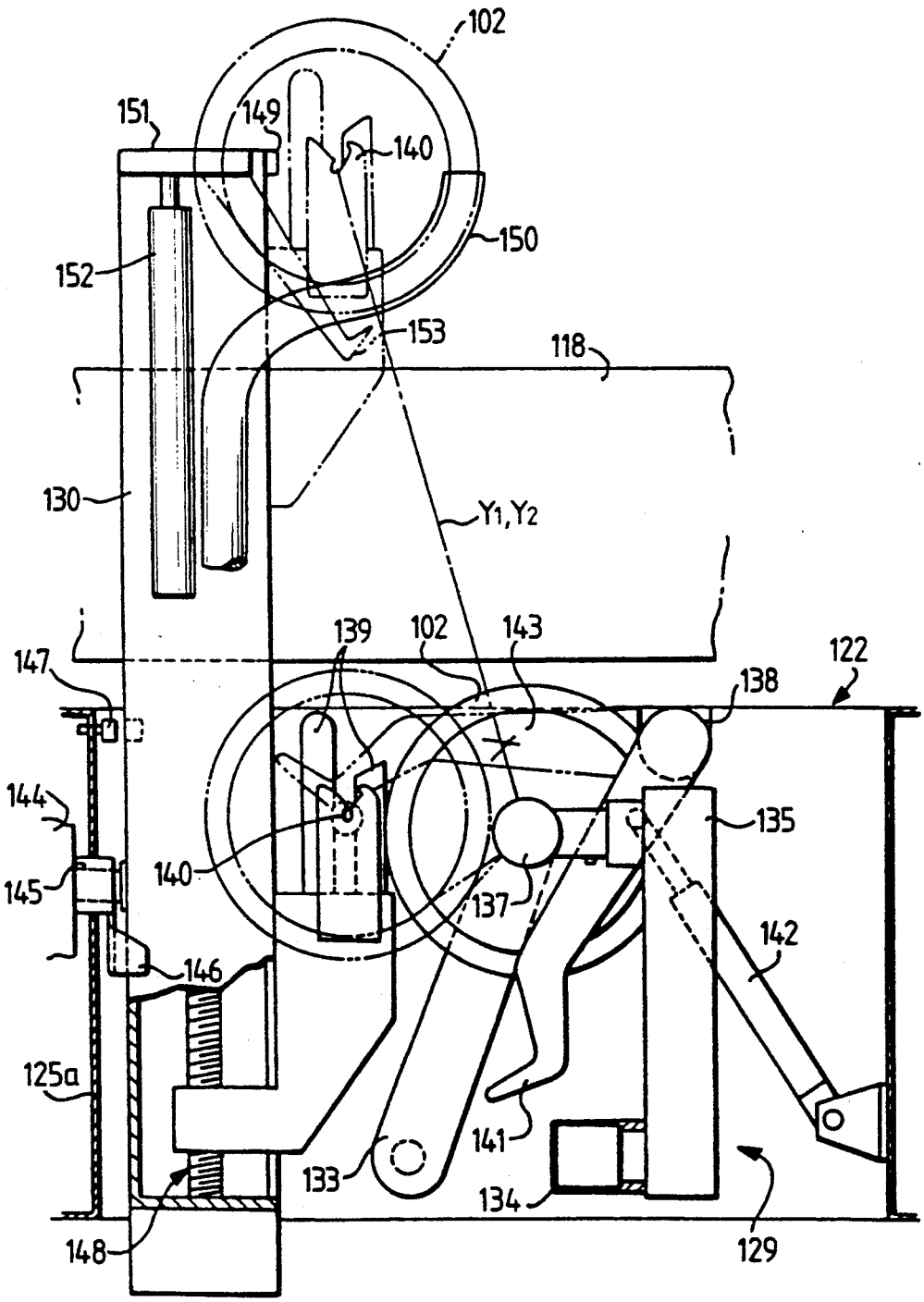
FIG. 9 is a partially enlarged plan view of the robot.

Substantially in the central portion of the robot body 125 is mounted the peg 128 through a turning arm 133 as shown in FIGS. 9 and 10. By turning of the turning arm 133, the feed package 102 is moved from the standby position indicated by the phantom line to the yarn end finding position indicated by the solid line away from the operating arm 130.

The yarn end finding mechanism 129 has a suction lever 135 connected to the upper end side of an erected suction cylinder 134 so that the suction lever 135 may be lowered and raised. A cylinder 136 for raising and lowering the suction lever 135 is connected to the latter. A suction mouth 137 is mounted on the extreme end of the suction lever 135 to suck and release (yarn end finding) the yarn end wound on the top cap 121 of the feed package 102.

A yarn gathering arm 141 is horizontally turnably provided on a bracket 138 erected in the neighbourhood of the suction mouth 137, the yarn gathering arm 141 catching a middle portion of the yarn end from the packages 102*a* and 102*b* of the feed package 102 yarn end found and returned to the stand-by position to the suction mouth 137 to deliver it to a yarn engaging member 140 mounted on a chucker 139 of the operating arm 130. A turning cylinder 142 is connected to the yarn gathering arm 141. A cutter 143 is provided in the neighbourhood of the suction mouth 137 so that when the yarn is placed in engagement with the yarn engaging member 140 by the yarn gathering arm 141 and the chucker 139 causes the feed package 102 to be carried on the spindle 103, the yarns Y1 and Y2 from the yarn engaging member 140 to the suction mouth 137 for threading are cut into a predetermined length.

The operating arm 130 is mounted to be raised and lowered through a support shaft 145 on an elevating block 144 provided movably up and down by an elevating mechanism such as a ball screw not shown along the lefthand inner wall 125*a* of the robot body 125, the operating arm 130 being horizontally supported with a rear upper surface thereof engaged by a stopper 146. On the left inner wall 125*a* is mounted a stopper 147 so as to project and retract the stopper 147 being engaged with the lower surface of the extreme end of the operating arm 130 which moves down in a horizontal state to erect and store the operating arm 130 on the side of the robot body 125 so as not to interfere the unit 101 during travelling.

The operating arm 130 has a length such that the extreme end thereof is positioned above the spindle 103 in a horizontal state, and a chucker 139 for gripping the top cap 121 of the feed package 102 is mounted on the side of the operating arm so that the chucker 139 may be moved in a longitudinal direction of the operating arm 130 through a screw feed device 148. A jet nozzle not shown is mounted above the chucker 139 to spray the yarns Y1 and Y2, which runs from the yarn engaging member 140 to the suction mouth 137 during threading, and cut by the cutter 143.

A sensor 149 is mounted on the extreme end of the operating arm 130 to detect presence or absence of a residual yarn of the feed package 102 on the spindle 102, and a suction pipe 150 is also mounted thereon which has a spindle for attracting and holding the yarn end threaded and blown upwardly of the spindle 103. A pusher 151 for pressing the drop wire 109 or the like to be returned is mounted through a cylinder 152 on the extreme end of the operating arm 130. From the pusher 151 is projected a yarn guide member 153 for guiding the yarn Y threaded and running between the feed package 102 and the suction pipe 150 so that the yarn is engaged with the snail wire 108 or the like.

Figure 8:
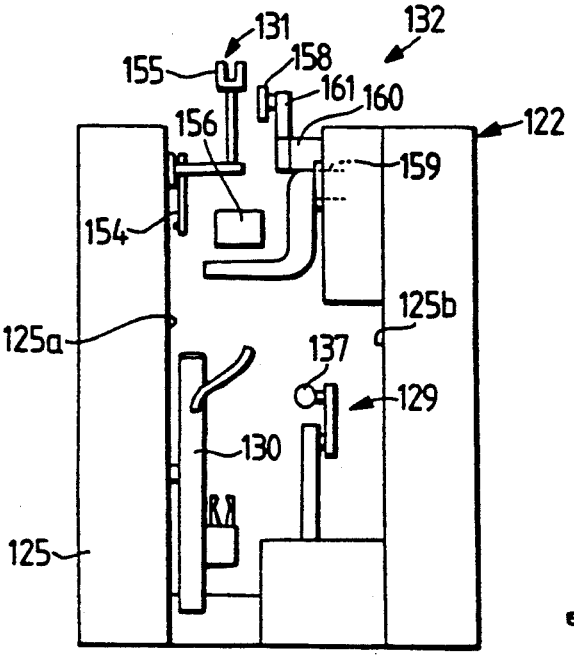
FIG. 8 is a front view of the robot.

On the other hand, as shown in FIG. 8, the doffing mechanism 131 is provided above the left inner wall 125*a* of the robot body 125, and the piecing mechanism 132 is provided above the right inner wall 125*b*. The doffing mechanism 131 is principally composed of a lever 154 for opening and closing an arm on one side of the cradle 105, a chute (not shown) for delivering the full winding package 107 removed from the cradle 105 to the conveyor 116, and a chucker arm 155 for supplying the paper tube 104 from the stocker 113 to the cradle 105.

Figure 11:
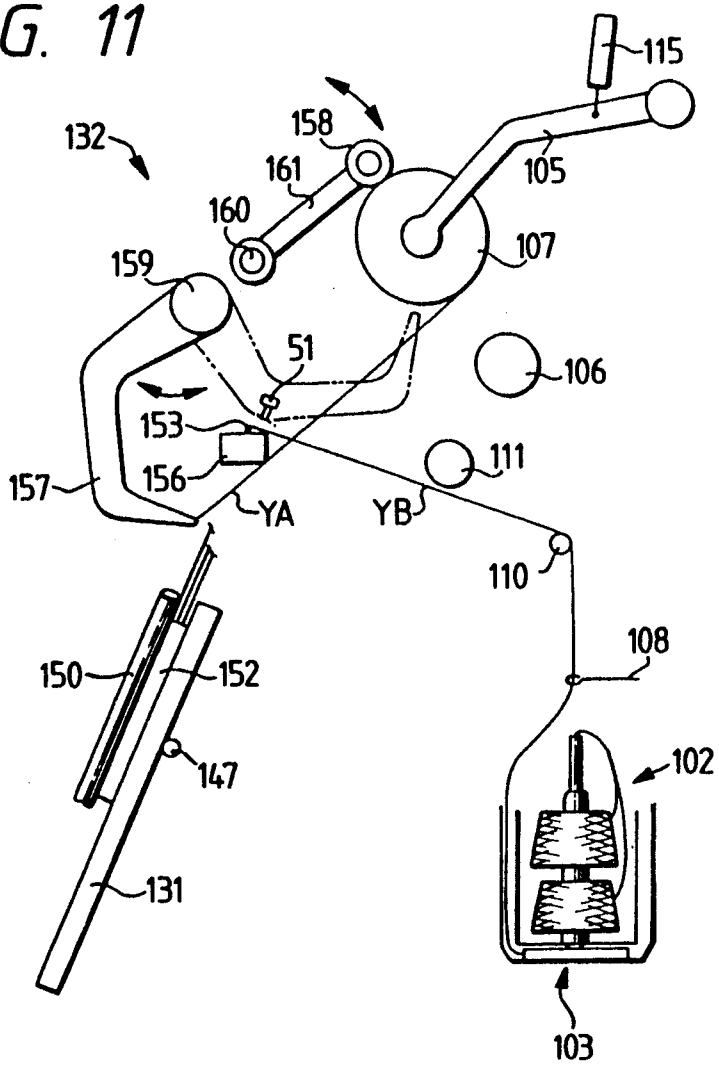
FIG. 11 is a side view showing a yarn piecing

The piecing mechanism 132 is principally composed as shown in FIG. 11 of an automatic piecing device 156, arms 157 and 130 for guiding a yarn end YA on the winding package 107 side and a yarn end YB on the feed package 102 side with respect to the piecing device 156, and a drive roller 158 in contact with the winding package 107 during piecing to rotate the package 107. As the piecing device 156, well known piecing devices have been used such as a knotter for mechanically connecting yarn ends together, a splicer for carrying out piecing without a knot by a turning air flow, and the like. The arm for guiding the yarn end YB on the feed package 102 side comprises the aforesaid operating arm 130, in which the yarn end YB on the feed package 102 side is guided to the front surface of the piecing device 156 by the tilting of the operating arm 130 and the yarn guide 153 similar to the engagement of yarn. The arm guiding the yarn end YA on the winding package 107 side comprises a suction arm 157 provided vertically turnably through a support pipe 159 projected on the right inner wall 125*b* of the robot body 125 in which the arm 157 comes closer to the winding package 107 of the cradle 105 raised by the cylinder 115 to thereby hold the yarn end YA so that it is guided to the front surface of the piecing device 156. The drive roller 158 is mounted on the extreme end of the drive lever 161 provided vertically turnably through a support shaft 160 projected in the neighbourhood of the support pipe 159 of the suction arm 157, in which when the yarn end YA is sucked from the drawn out of the winding package 107 by the suction arm 157, the drive roller 158 comes into contact with the winding package 107 to rotate the latter in a yarn release direction (clockwise in FIG. 11), and after completion of piecing, the package 107 is rotated in a winding direction (counterclockwise).

In the above-described embodiment, particularly breakage occurs during operation, the drop wire 109 drops, and the display lamp 114 is turned on and the cradle 105 is raised by cylinder 115. When the sensor 126 detects the turned on display lamp 114 during moving round, the robot 101 stops at the front surface of the unit 101, and the operating arm 130 is put to a horizontal attitude and the presence or absence of the residual yarn of the feed package 102 is assured by the sensor 149. If the residual yarn is not present, changing of yarn is carried out whereas if the residual yarn is present, piecing starts.

When the yarn breakage occurs, one yarn end YA cut is wound on the winding package 107, a portion of the other yarn end YB externally of the spindle 103 is torn off by rotation of the spindle 103, and a portion internally of the spindle 103 is excessively twisted by rotation of the spindle 103. Therefore, the feed package 102 is once relocated to the peg 128 of the robot 122 by the operating arm 130, and yarn end finding of the yarn end YB is carried out by the yarn end finding mechanism 129.

After completion of the yarn end finding, the feed package 102 is returned onto the spindle 103 to effect threading, the yarn end YB blown upwardly of the spindle 103 is sucked and retained by the suction pipe 150 of the operating arm 130, and the yarn end YB running from the spindle 103 to the suction pipe 150 is passed over the snail wire 108 and the yarn guide roller 110 by the tilting of the operating arm 130 and the operation of moving the yarn guide 153 forward and backward, after which the yarn end YB is guided onto the piecing device 156.

On the other hand, the drive roller 158 is placed in contact with the winding package 107 raised from the rotary drum 106 and stopped, and the suction arm 157 comes closer. The surface of the yarn layer is sucked while rotating the winding package 107 in a direction of releasing the yarn whereby the yarn end YA is drawn and guided onto the piecing device 156. The thus guided yarn ends YA and YB are subjected to automatic piecing by the piecing device 156. After completion of piecing, the winding package 107 is rotated in a winding direction by the drive roller 158, and the drive roller 158 is returned toward the robot 122 and the cradle 105 is pressed down to bring the winding package 107 into contact with the rotary drum 106 whereby the operation restarts.

In this manner, the robot 122 can automatically carry out piecing of each unit 101, whereby all the operation necessary for automatic operation of the double twister becomes enabled to considerably relieve labor. In prior art, since one winding package 107 is formed from one feed package 102, a large package 102 is necessary to form a large winding package 107. However, since piecing can be made, a plurality of feed packages 102 can be spliced to form a large winding package 107. Furthermore, the feed package 102 is miniaturized to miniaturize the spindle 103 and reduce consumption power.

While in the above-described embodiment, a description has been made of the case where a two-stage feed package is used as the feed package 102, it is to be noted that a single stage feed package doubled in advance may used. Furthermore, while in the embodiment, the feed package 102 is, in piecing, once moved to the peg 128 on the robot 122 side for yarn end finding, it is to be noted that since the yarn end YB remains within the adapter 119, threading may be carried out directly by the function of compression air caused by the deep stepping operation of the pedal without carrying out the yarn end finding operation.

Figure 12:
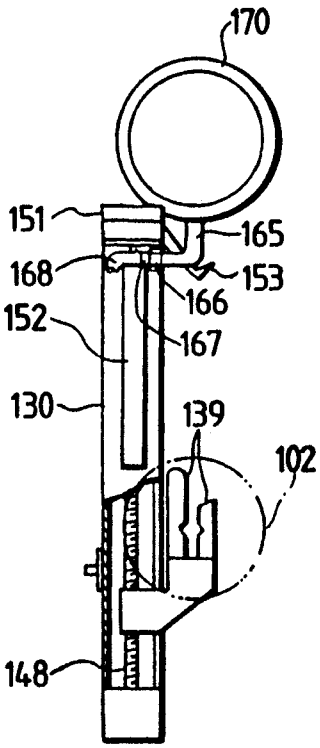
FIG. 12 is a plan view showing another embodiment of a suction arm.

When the yarn threading operation is processed by means of the suction pipe 150 shown in FIG. 9, a stop device for stopping a spindle at a predetermined position has to be provided. If a suction ring 170 shown in FIG. 12 is provided, the yarn threading operation may be done more easily and accurately.

The suction ring 170 is formed to be a circular form along a blowing-up opening of the spindle 103 and a suction slit is formed continuously along the peripheral lower face of the suction ring 170. A suction tube 165 of L-shape is connected to the suction ring 170 and the base end portion of the suction tube 165 is rotatably supported by a bearing 166 on the upper top end portion of the operating arm 130. The base end of the suction pipe 165 is connected to a suction hose 168 from the suction source through a pivotal joint 167. A driving device (not shown) for turning motion of the suction ring 170 of gear type or cylinder-drive type, for example, is connected to the suction ring 170 so that the suction ring 170 may be turned from the storing position turned-up over the operating arm 130 to the position shown by a solid line where it is placed in horizontal operating position above the blowingup opening of the spindle 103.

In short, according to this embodiment, it is possible to automatically carry out piecing with respect to a unit involving a yarn breakage.

In the aforesaid robot, the robot itself carries out yarn end finding and threading, and therefore, the construction becomes complicated. Even a feed package having failed to carry out yarn end finding (mis-yarn-end finding package) is supplied to the spindle of the unit. Therefore, in case of the mis-yarn-end finding package, threading cannot be made. This merely relies upon processing by an operator. Processing efficiency is sometimes poor.

It is therefore a still another object of the present invention to provide a feed carrying system in a double twister in which a mis-yarn-end finding package is not supplied to the spindle of the unit and the construction of the robot is simplified and the processing efficiency is enhanced.

For achieving the aforementioned object, this embodiment of the present invention provides the system comprising a conveyor for carrying feed packages along units of a plurality of juxtaposed double twisters, and a yarn end finding device provided on the inlet side of said conveyor to insert a yarn end drawn out of the surface of a yarn layer of the feed package into a center hole.

A feed package supplied from a winder or the like is subjected to yarn end finding processing by a yarn end finding device in which a yarn end is drawn out of the surface of a yarn layer and inserted into a center hole thereof, after which the feed package is supplied to the unit by means of a conveyor.

Accordingly, the robot may replace the feed package with an empty feed package on the spindle of the unit. Since a yarn end is inserted into the center hole in advance, threading can be easily carried out on the unit side. A yarn end finding mechanism and a threading mechanism of the robot are not necessary, and the construction of the robot is simplified.

Furthermore, it is not necessary to carry out yarn end finding on the robot and supply a mis-yarn-end finding package to the spindle of the unit, as a result of which one waits for operator's processing, thus enhancing the processing efficiency.

The embodiment of the present invention will be described in detail with reference to the accompanying drawings.

Figure 13:
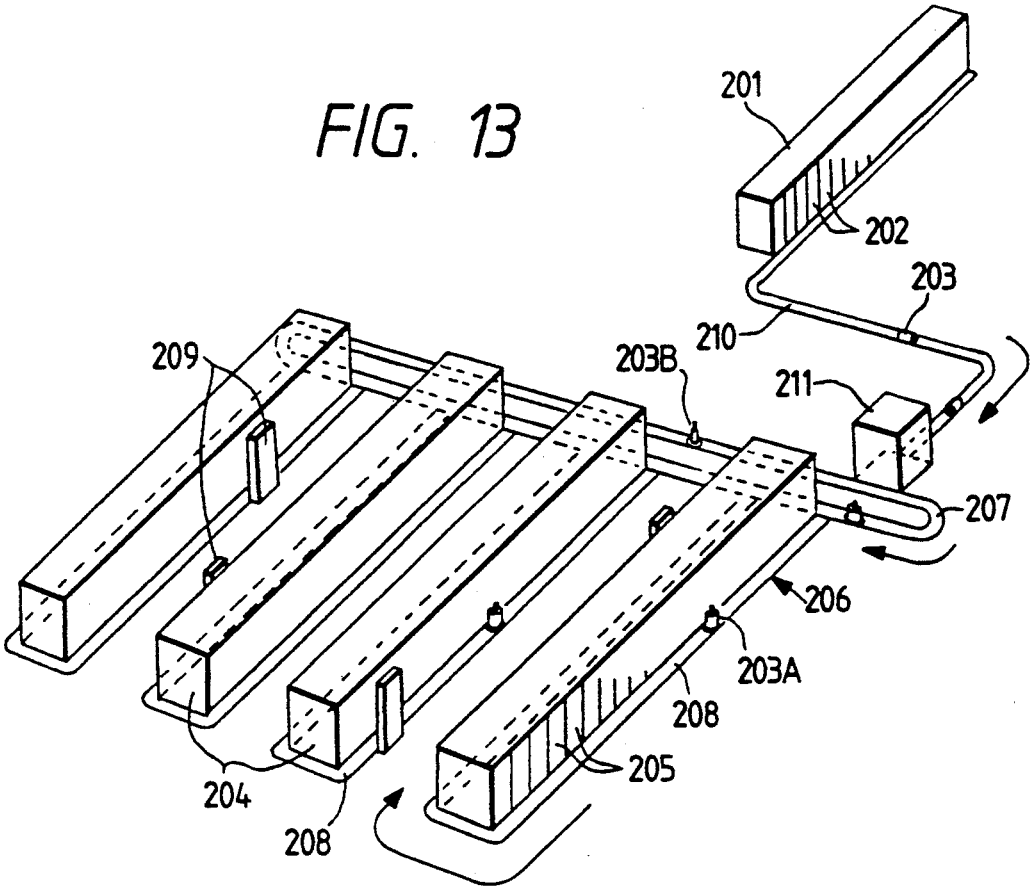
FIG. 13 is a perspective view showing one embodiment of a feed package carrying system of a double twister according to the present invention.

In FIG. 13 showing a yarn carrying system in a double twister, reference numeral 201 designates a feed package producing section for a spinning machine for producing feed packages, a winder or a doubler. Feed packages 203 are produced by a plurality of units 202 constituting the feed package producing section 201. In the present embodiment, as the feed package producing section 201, a special spinning machine for doubling two yarns while spinning them is used. A plurality of double twisters 204 are provided adjacent to the feed package producing section 201. The double twisters 204 are each provided with a plurality of units 205 juxtaposed laterally and back to back. In the illustrated example, four rows of double twisters 204 are shown.

In each of the double twisters 204, a conveyor 206 for supplying the feed package 203 to the unit 205 is provided along the units 205. This conveyor 206 is composed of a common circulating conveyor 207 arranged on one end of the double twister 204 and a branch conveyor 208 branched so as to go round each double twister 204 from the circulating conveyor 207, either of which comprises a belt conveyor. Each of the double twisters 204 is provided with a robot 209 which travels along the units 205. The robot 209 replaces an actual feed package 203*a* on the branch conveyor 208 with an empty feed package 203 of the unit, which will be described later. The empty feed package (empty bobbin) 203*a* is discharged onto the branch conveyor 208 and discharged from the branch conveyor 208 to the circulating conveyor 207. Therefore, a select and supply mechanism (not shown) for selecting only the actual feed packages 203A to supply the same to the branch conveyor 208 is installed at a connection between the outlet end of the branch conveyor 208 and the circulating conveyor 207.

Figure 14:
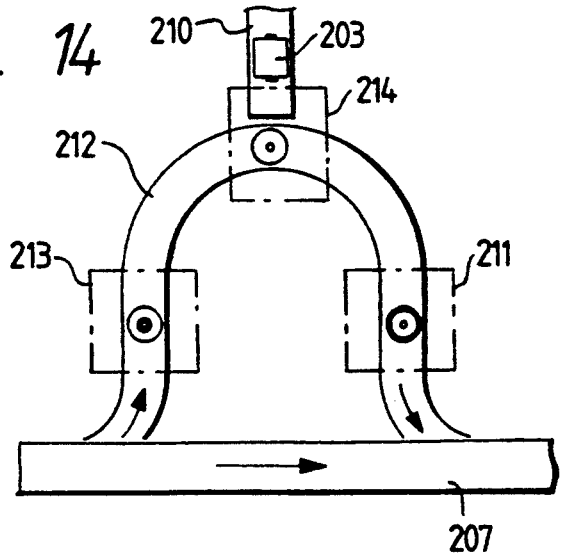
FIG. 14 is a plan view of a yarn end finding device portion of the system.

The circulating conveyor 207 is provided with a yarn end finding device 211 for yarn end finding the feed package 203 supplied from the feed package producing section 201 by the supply conveyor 210. More specifically, as shown in FIG. 14, a U-shaped carrying path 212 is connected to the circulating conveyor 207, and only the empty feed package 203B selected by the select and supply mechanism not shown installed at the inlet end is supplied to the carrying path 212. An empty feed package pull-out device 213, an actual feed package supply device 214 and a yarn end finding device 211 are installed in order from upstream on the carrying path 212.

Figure 17:
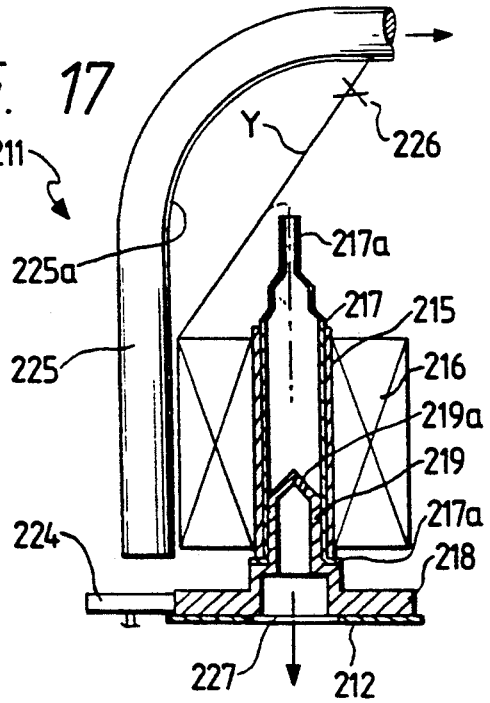
FIG. 17 is a sectional view showing the configuration of the yarn end finding device.
Figure 18:
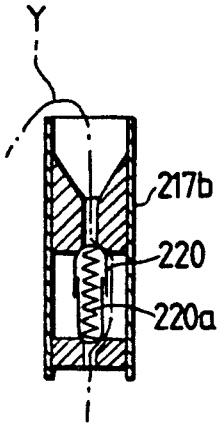
FIG. 18 is a partial sectional view of an adapter of a feed package.

As shown in FIG. 17, the feed package 203 is formed by winding a yarn on a cylindrical bobbin 215 to form a yarn layer 216, the feed package 203 being erected on a peg 219 of a carrying tray 218 through an adapter 217. The carrying tray 218 is formed into a cylindrical configuration of which bottom is opened, and the peg 219 is formed with a through-hole 219*a*. The adapter 217 is formed into a hollow cylindrical configuration capable of being inserted into a center hole of the feed package 203, the adapter 217 having its lower end formed with a flange portion 217*a* in engagement with an end of the bobbin 215 of the feed package 203. The adapter 217 is integrally formed in its upper end with a top cap portion 217*b* for guiding a yarn end Y into the adapter 217 and incorporates therein a capsule-like tenser 220*a* which houses a spring 220 so that the tenser 220 may be contracted to apply a predetermined tension to a travelling yarn during operation of the units.

Figure 15:
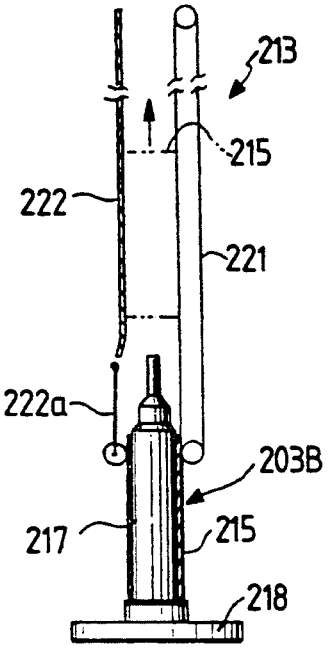
FIG. 15 is a front view showing a device for pulling out an empty feed package on a tray.

The empty feed package pull-out device 213 comprises a belt conveyor 221 positioned on one side of an empty bobbin 215 of the empty feed package 203B erected on the carrying tray 218 through the adapter 217 as shown in FIG. 15 and vertically arranged, and a guide plate 222 having an introducing lever 222*a* at the lower end thereof so that when the empty bobbin 215 is held between the introducing lever 222*a* and the belt conveyor 221, the empty bobbin 215 is pulled out of the adapter 217 and held between the guide plate 222 and the belt conveyor 221 and delivered upward.

Figure 16:
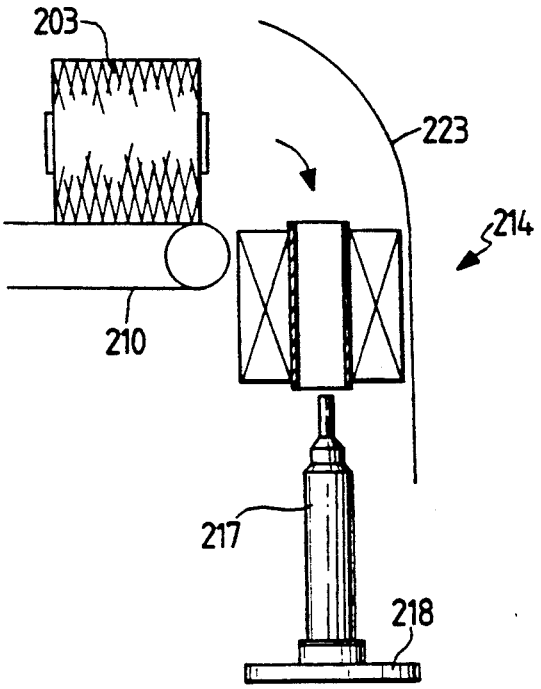
FIG. 16 is a side view showing a device for supplying a feed package to a tray.

In the feed package supply device 214, the outlet end of the supply conveyor 210 formed from a belt conveyor is arranged upwardly of the carrying path 212 as shown in FIG. 16, and when the feed package 203 carried while being placed with the axis thereof registered along the carrying direction of the supply conveyor 210 drops from the outlet end along the guide plate 223, it is fitted into the adapter 217 of the standby carrying tray 218 at the lower portion.

The yarn end finding device 211 is principally composed, as shown in FIG. 17, a drive roller 224 in contact with an outer peripheral portion of the carrying tray 218 to rotate the feed package 203 in a direction of releasing the yarn end, a suction pipe 225 arranged on one side of the feed package 203 and having a suction slit 225*a* for sucking the yarn end to guide it so as to cross the upper portion of the center hole of the feed package 203, a cutter 226 for cutting the yarn end Y released in suction along the slit 225*a* and guided upwardly into a predetermined length, and a suction source (not shown) provided below the carrying path 212 through a suction port 227 thereof to suck and insert into the adapter 217 the yarn end Y sucked into the adapter 217 through a through-hole 219*a* of the carrying tray 218 and cut.

Operation of the embodiment will be described hereinafter.

The feed package (doubled one in the embodiment) 203 produced in the feed package producing section 201 is carried to the yarn end finding device 211 by the supply conveyor 210. In this case, the tray 218 with the empty feed package 203B after replacement of the feed erected has already been introduced into the carrying path 212 of the yarn end finding device 211. First, the empty feed package pull-out device 213 pulls out the empty bobbin 215 from the adapter 217 on the tray 218, and then the feed package supply device 214 causes the feed package 203 carried by the supply conveyor 210 to be fitted into the adapter 217 with the empty bobbin 215 pulled out therefrom. The yarn end finding device 211 sucks and pulls out the yarn end Y from the suction slit 225*a* of the suction pipe 225 from the yarn layer surface 216 of the feed package 203, the yarn end Y being cut into a predetermined length by the cutter 226, after which the yarn end Y is inserted into the center hole (within the adapter 217) by the suction flow.

The feed package 203 thus subjected to the yarn end finding is supplied to the circulating conveyor 207, and carried along the units 205 of the double twister 204 by the branch conveyor 208. In this case, since the yarn end Y subjected to yarn end finding of the feed package 203 is held by the tenser 220 within the adapter 217, the yarn end Y is not possibly slipped out of the adapter 217 during the carrying.

The robot 209 travelling along the units 205 detects the unit 205 capable of doffing and stops to carry out the yarn changing or the like.

After the changing, the empty feed package 203B is carried from the branch conveyor 208 to the yarn end finding device 211 by the circulating conveyor 207, and the package is pulled out from the tray 218 and delivered, and a new feed package 203 is mounted on the tray 218 and supplied to the unit 205. This cycle is repeated.

When the actual feed package 203A is supplied to the spindle 228 of the unit 205, threading is carried out by the known compression air type threading construction incorporated into the spindle 228 is carried out. Since the yarn end is inserted into the adapter 217 in advance, it is possible to positively and easily carry out the threading.

The feed package 203 is subjected to yarn end finding processing in advance as described above. Therefore, the robot 241 may replace the feed package 203 with the empty feed package 203B on the spindle 228. Threading may be easily carried out on the unit 205 side. The yarn end finding mechanism and threading mechanism of the robot 241 are not necessary, and the construction of the robot 241 can be simplified. Furthermore, it is not necessary to carry out the yarn end finding on the robot and supply a mis-yarn-end finding package to the spindle 228 of the unit 205, after which one waits for operator's processing. Therefore, the processing efficiency is improved.

What is claimed is:

1. An apparatus for conducting a doffing operation in a double twister, comprising:

yarn supply means for supplying yarn from a bobbin to a package, winding means for winding the yarn onto the package, package full signal means for providing a package full signal when the package wound by the winding means is full, and work means for doffing a full package and for changing the bobbin, the work means including remaining yarn detection means for detecting a predetermined amount of yarn remaining on the bobbin, the work means being responsive to the package full signal and the amount of yarn remaining on the yarn supply bobbin, wherein the work means doffs the package and does not change the bobbin when the amount of yarn remaining on the bobbin exceeds the predetermined amount, wherein the work means doffs the package and changes the bobbin when the amount of yarn remaining on the bobbin does not exceed the predetermined amount, and wherein the predetermined amount corresponding to the amount of yarn required to wind a full package.

2. An apparatus according to claim 1, wherein the winding means including a plurality of winding units for winding a plurality of packages, the yarn supply means includes a plurality of bobbins, each bobbin being associated with a respective winding unit, and wherein the package full signal means includes a plurality of package full signalling units, each package full signalling unit being disposed on a respective winding unit and providing a package full signal when a package being wound by the respective winding unit is full.

3. An apparatus according to claim 2, wherein the work means includes travelling means for enabling the work means to travel between the plurality of winding units, the work means being responsive to a package full signal from at least one package full signalling unit disposed on a respective winding unit, wherein the work means stops at the respective winding unit in response to the package full signal.

4. An apparatus according to claim 2, wherein each of the winding units comprise a yarn length counter, and wherein each of the plurality of the package full signalling units provides a package full signal when a predetermined length of yarn has been wound onto a package.

5. An apparatus according to claim 1, wherein the winding means comprises a yarn length counter, and wherein the package full signal means provides the package full signal when a predetermined length of yarn has been wound onto a package.

6. An method for conducting a doffing operation in a double twister, comprising the steps of:

supplying yarn from a bobbin, winding the yarn onto a package, providing a package full signal when the package is full, determining if a predetermined amount of yarn remains on the yarn supply bobbin, doffing the package without changing the bobbin when the amount of yarn remaining on the bobbin exceeds the predetermined amount, and doffing the package and changing the bobbin when the amount of yarn remaining on the bobbin does not exceed the predetermined amount.

7. An method according to claim 6, wherein the winding step is simultaneously performed in a plurality of winding units for winding a plurality of packages, the step of supplying yarn includes supplying yarn from a plurality of bobbins, each bobbin being associated with a respective winding unit, and wherein the step of providing a package full signal includes providing a respective package full signal for each of the plurality of winding units when a respective package being wound by a respective winding unit is full.

8. An apparatus for conducting a doffing operation and a bobbin changing operation in a twister, the apparatus comprising:

winding means for winding yarn from a bobbin onto a package, package full signal means for providing a package full signal when the package is full, remaining yarn detection means for detecting an amount of yarn on the bobbin which exceeds a predetermined amount, and work means for doffing the package and for changing the bobbin, wherein the work means doffs the package and does not change the bobbin in response to the full package signal when the remaining yarn detection means detects that the amount of yarn on the bobbin exceeds the predetermined amount, and wherein the work means doffs the package and changes the bobbin in response to the full package signal when the remaining yarn detection means detects that the amount of yarn on a bobbin does not exceed the predetermined amount.

9. An apparatus for conducting a doffing operation and a bobbin changing operation in a twister, the apparatus comprising:

winding means for winding yarn from a bobbin onto a package, package full signal means for providing a package full signal when the package is full, remaining yarn detection means for detecting an amount of yarn on the bobbin, the amount being greater than a predetermined amount, the predetermined amount being an amount greater than zero, and work means for doffing the package and for changing the bobbin, wherein the work means doffs the package and changes the bobbin in response to the full package signal and the remaining yarn detection means detecting that the amount of yarn on the bobbin does not exceed the predetermined amount.

* * * * *